US007624509B2

(12) United States Patent
Hanson et al.

(10) Patent No.: US 7,624,509 B2
(45) Date of Patent: Dec. 1, 2009

(54) CHALK BOX

(75) Inventors: Phil Hanson, Lisle, IL (US); James W. Woodside, Middleton, WI (US)

(73) Assignee: The C.H. Hanson Company, Naperville, IL (US)

( * ) Notice: Subject to any disclaimer, the term of this patent is extended or adjusted under 35 U.S.C. 154(b) by 0 days.

(21) Appl. No.: 11/897,973

(22) Filed: Aug. 31, 2007

(65) Prior Publication Data

US 2008/0052935 A1 Mar. 6, 2008

Related U.S. Application Data

(60) Provisional application No. 60/841,892, filed on Sep. 1, 2006.

(51) Int. Cl.
*B44D 3/38* (2006.01)

(52) U.S. Cl. ..... 33/414

(58) Field of Classification Search ..... 33/414
See application file for complete search history.

(56) References Cited

U.S. PATENT DOCUMENTS

| | | | | | |
|---|---|---|---|---|---|
| 754,827 | A * | 3/1904 | Thompson | 33/414 |
| 3,126,637 | A * | 3/1964 | Short | 33/414 |
| 3,438,595 | A * | 4/1969 | West et al. | 33/414 |
| 3,888,010 | A * | 6/1975 | Hyde et al. | 33/414 |
| 4,565,011 | A * | 1/1986 | Karger | 33/414 |
| 4,765,557 | A * | 8/1988 | Kahmann | 33/414 |
| 5,042,159 | A * | 8/1991 | Millen | 33/414 |
| 5,493,787 | A | 2/1996 | Owens | |
| 5,644,852 | A * | 7/1997 | Fuller et al. | 33/414 |
| 5,683,055 | A * | 11/1997 | Dufour | 242/394 |
| 5,822,874 | A * | 10/1998 | Nemes | 33/414 |
| 5,920,997 | A * | 7/1999 | Girtman | 33/414 |
| 6,079,112 | A | 6/2000 | Love | |
| 6,289,597 | B1 | 9/2001 | Beyers | |
| 6,745,485 | B2 | 6/2004 | Shor | |
| 6,895,679 | B2 | 5/2005 | Dekort | |
| 6,915,587 | B1 | 7/2005 | Scillia et al. | |
| 6,931,742 | B1 | 8/2005 | VanWinkle | |
| 6,957,495 | B1 | 10/2005 | Schmillen | |
| 7,197,831 | B2 | 4/2007 | Nepil | |
| 7,197,832 | B2 | 4/2007 | Bond | |
| 7,231,722 | B2 * | 6/2007 | Hickey et al. | 33/414 |
| 7,311,283 | B2 | 12/2007 | Whitney | |

* cited by examiner

*Primary Examiner*—Christopher W Fulton
(74) *Attorney, Agent, or Firm*—Foley & Lardner LLP

(57) ABSTRACT

A chalk box including a housing, a reel, a line, an opening through which the line enters and exits the housing, and a removable cap located proximate the opening. The chalk box may also include a seal or seals located between the handle and the chalk to inhibit entry of chalk in the area between the handle and the reel. The chalk box may also include one or more flat areas on the bottom surface of the chalk box to stabilize the chalk box during operation.

19 Claims, 7 Drawing Sheets

FIG. 10
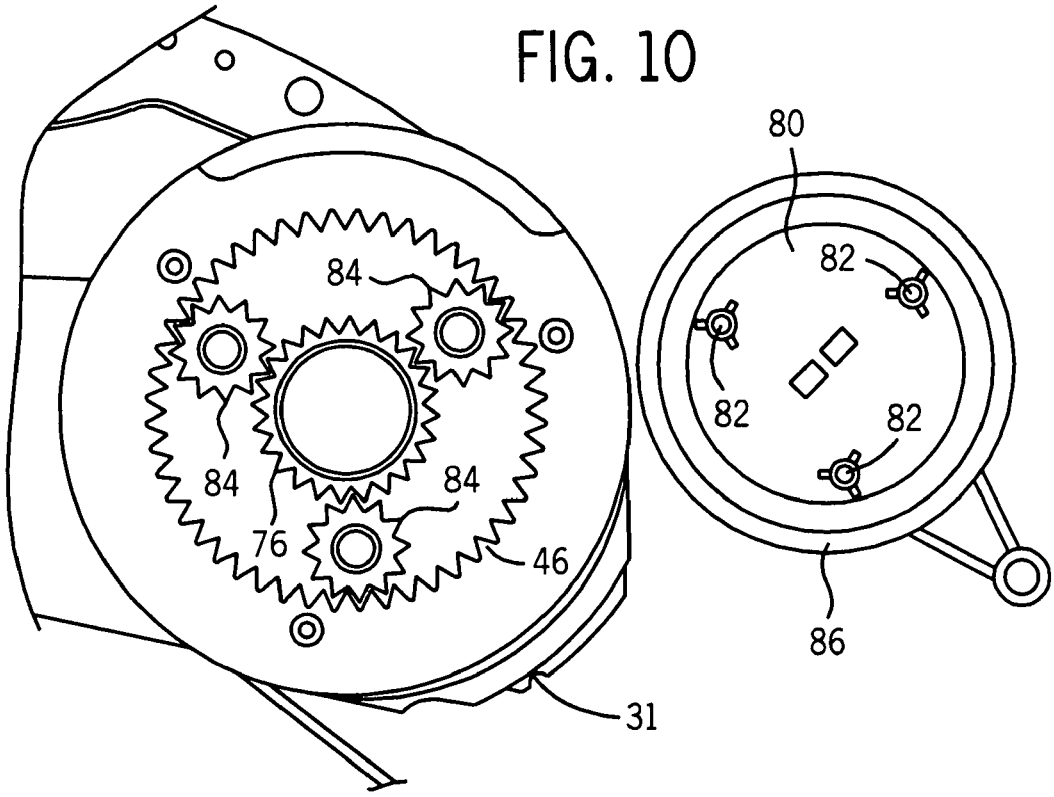
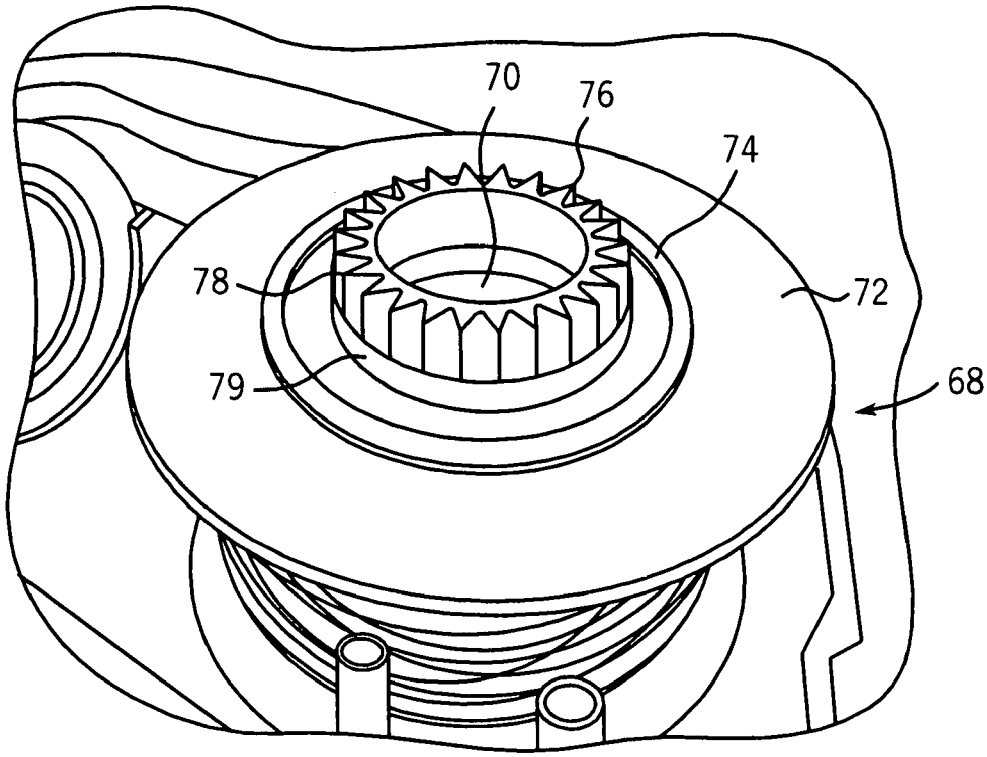
FIG. 11

CHALK BOX

CROSS REFERENCE TO RELATED APPLICATIONS

This application claims benefit of U.S. Provisional Application No. 60/841,892 filed Sep. 1, 2006, which is incorporated herein.

BACKGROUND

This disclosure relates generally to the field of chalk boxes, also referred to as a chalk line dispenser. Chalk boxes are well known in the art to create a straight line for use in construction. A line wound about a reel is covered with chalk. The line is then pulled from the reel. A portion of the line proximate a first end of the line is held against a surface to be marked. A second portion of the line is held against the surface a distance apart. The line is held taught between the two points. A user then raises a portion of the line between the two portions held against the surface under tension, when the line is released the line snaps back toward the surface depositing a straight line of chalk along the surface. The line is then wound back on to the reel. Typically the reel is located within a housing. If the line is dragged through debris some of the debris may enter the housing and foul the line for future use. The debris may also act to block the line from being easily withdrawn from the housing or reeled back on to the reel. Additionally, if the line becomes wet during use, the wet line will form a cake of wet chalk within the housing that may also prevent the line from being easily withdrawn from the housing. Cleaning the housing requires that the chalk box be disassembled. This requires time and may not be easily accomplished. The line is reeled back into the housing through the use of a handle located external to the housing. Any chalk that enters the area proximate the handle may foul the mechanism that couples the handle to the reel thereby inhibiting the proper and easy winding or unwinding of the line.

It would be desirable to provide a chalk box that would address these shortcomings. Specifically, it would be desirable to provide a chalk box that would minimize debris from entering the housing. Further it would be desirable to provide a chalk box that could be easily accessed to remove any debris that may enter the chalk box. Additionally, it would be desirable to provide a chalk box that minimized the amount of moisture that could enter the housing via the line as it is being reeled back into the housing. It would also be desirable to provide a chalk box that inhibited the chalk from entering the area proximate the handle to ensure smooth operation of the reel.

SUMMARY

One embodiment of the invention relates to a chalk line dispenser including chalk and chalk line. The dispenser comprises a housing defining a chamber, a gear system disposed in the chamber, a reel assembly disposed in the housing and coupled to the gear box, the reel assembly including flange and a gear. There is also provided a first seal having a first diameter disposed on the flange and a second seal having a diameter smaller than the first diameter disposed on the flange intermediate the gear and the first seal. Wherein the first and second seal when compressed against the flange prevent chalk from entering the gear system.

Another embodiment provides a chalk line dispenser comprising a housing including a nose portion defining an aperture. A chalk line reel is contained in the housing, with chalk line disposed on the reel and extending through the aperture. A cap is selectively removable and configured to couple to the nose portion with a snap fit.

There is further provided a chalk line dispenser comprising a housing including a nose portion, a bottom surface, and a rear portion and a flat area defined by at least a portion of the bottom surface proximate the rear portion. Wherein the flat area facilitates housing stability during operation of the chalk line dispenser.

BRIEF DESCRIPTION OF THE DRAWINGS

FIG. 10 is a left elevation view of the chalk box in FIG. 1 showing the gear mechanism.

FIG. 11 is a perspective view of the reel in FIG. 2.

DESCRIPTION

Figure 1:
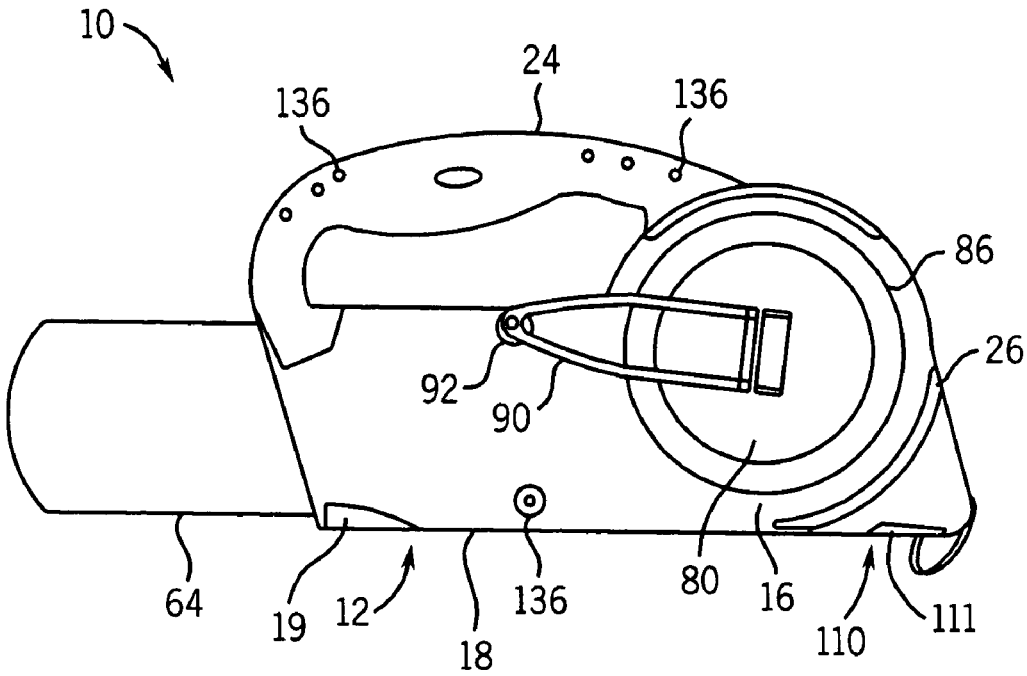
FIG. 1 is a left elevation view of a chalk box according to an exemplary embodiment.
Figure 2:
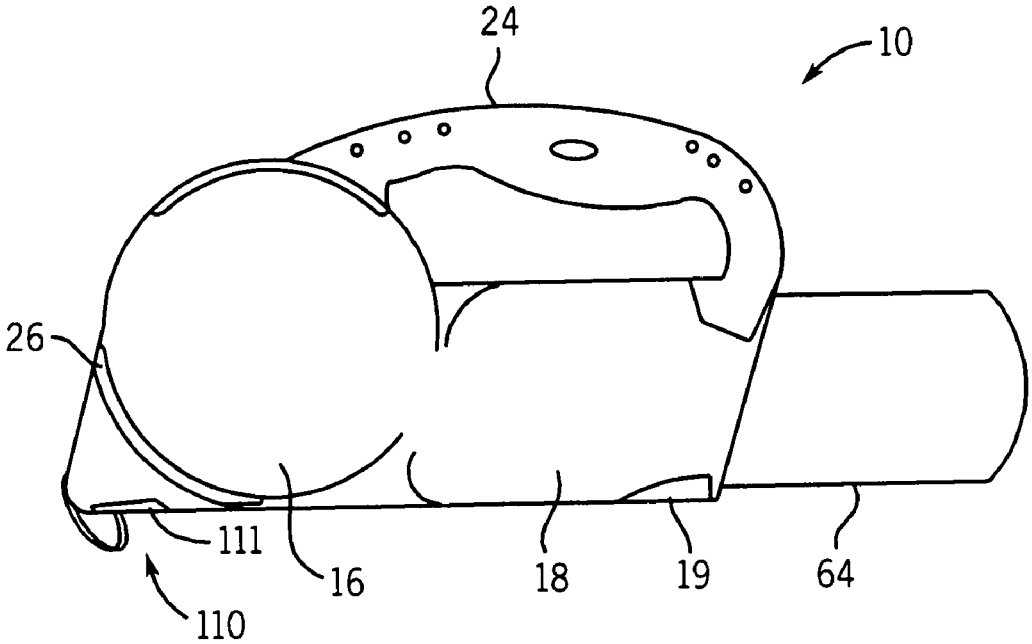
FIG. 2 is a right elevation view of the chalk box in FIG. 1.
Figure 3:
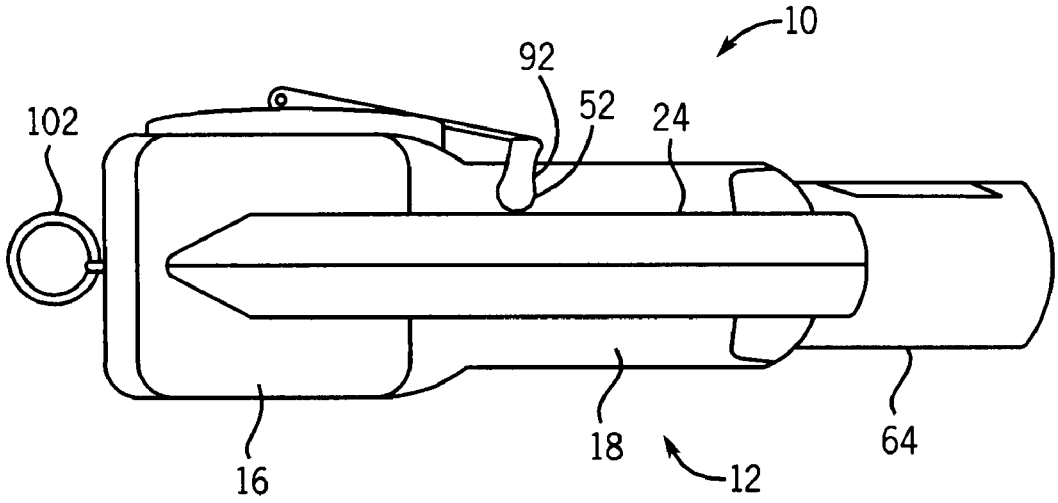
FIG. 3 is a top plan view of the chalk box in FIG. 1.

For purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring to the FIGURES, a chalk box 10 is shown according to an exemplary embodiment. Chalk box 10 comprises a main body 12, an insert 54, a reel mechanism 66, a maintenance cap 110, one or more seals 94, 96, 130, and 132, and a string 100. Chalk box 10 is configured to provide a retractable string or cable 100 that may be at least partially coated chalk. String 100 is held against a body to be marked (e.g., a piece of lumber) and snapped, leaving behind a chalk line.

Figure 8:
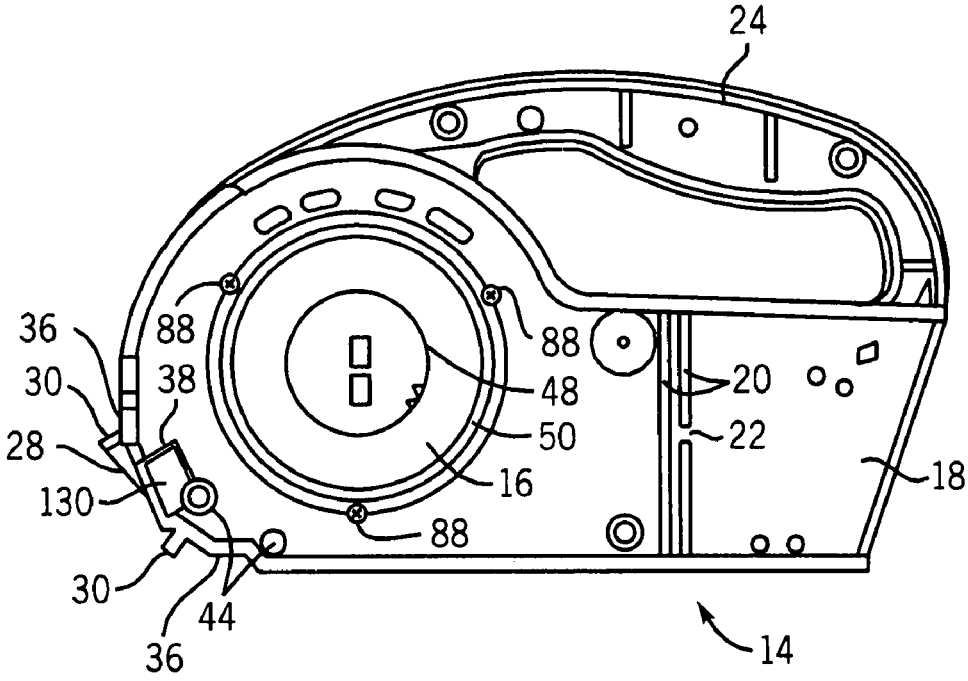
FIG. 8 is an elevation view of a first half of the chalk box in FIG. 1.
Figure 9:
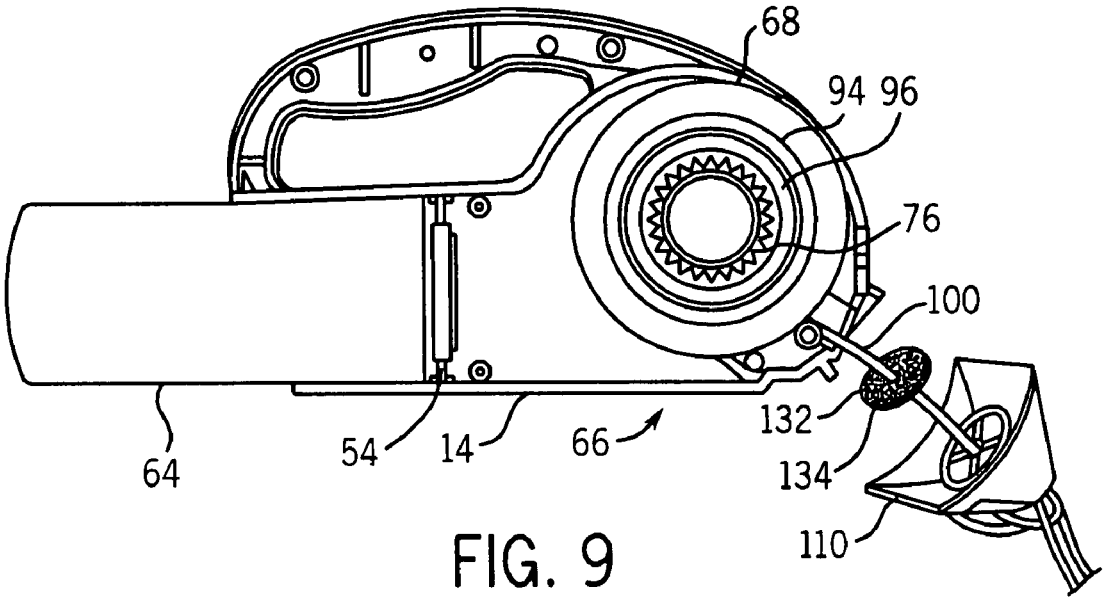
FIG. 9 is an elevation view of a second half of the chalk box in FIG. 1.

Referring to FIGS. 8 and 9, the interior components of chalk box 10 are shown in greater detail. Main body or housing 12 comprises two body halves 14 that are coupled together with fasteners 136 to at least partially enclose the other components of chalk box 10. Body 12 includes a chamber 16, a receiving structure 18, a handle 24, and a nose or outlet portion 26. According to an exemplary embodiment, body 12 is injection molded nylon 6. According to other exemplary embodiments, body may be another material with suitable properties or may be formed by other processes.

Figure 4:
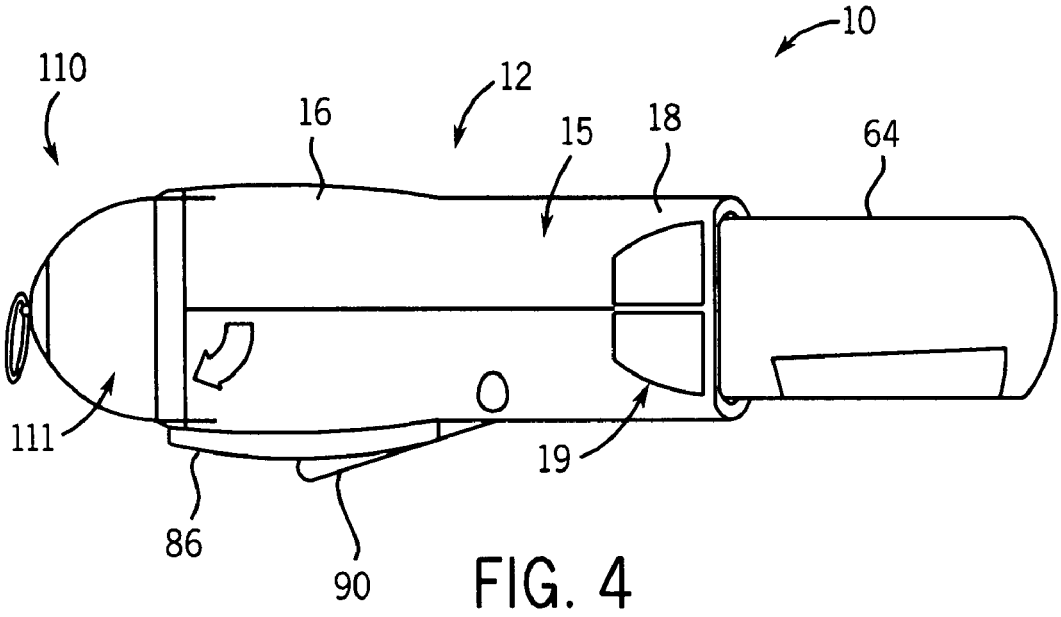
FIG. 4 is a bottom plan view of the chalk box in FIG. 1.
Figure 5:
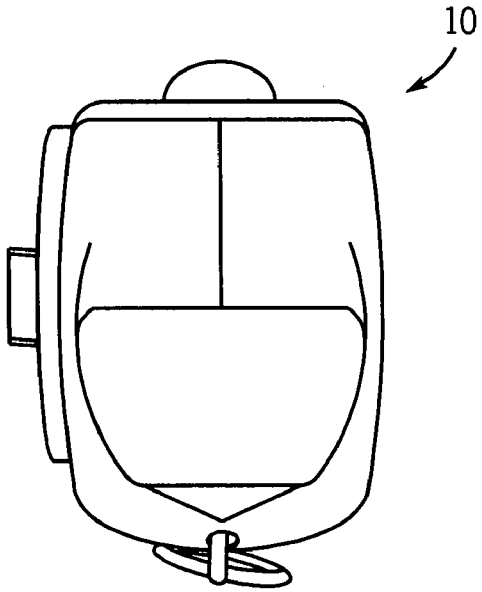
FIG. 5 is a front elevation view of the chalk box in FIG. 1.
Figure 6:
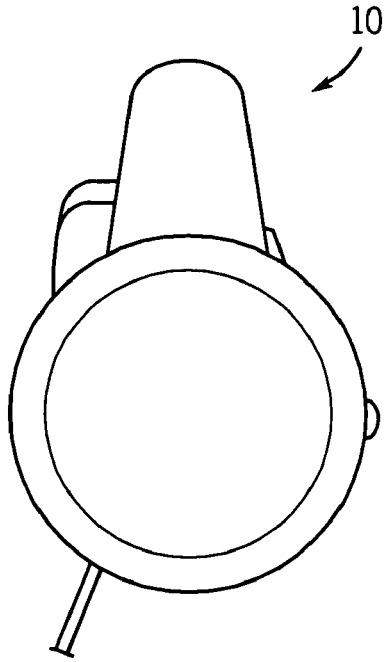
FIG. 6 is a rear elevation view of the chalk box in FIG. 1.

As illustrated in FIG. 4, the housing 12 includes a bottom surface 15. The bottom surface 15 defines a flat area 19 proximate the receiving structure 18 (also referred to as a rear portion of the housing 12). The flat area 19 facilitates stabilizing the housing 12 when down pressure is applied to the chalk line dispenser 10, (also referred to as a chalk box) during operation of the chalk box, such as when the chalk line is "snapped" to deposit the chalk. An additional cap flat area 111 defined on the maintenance cap 110 further facilitates the chalk box 10 stability during operation. The cap flat area 111 aligns with the flat area 19 to define a plane along the bottom surface 15 of the chalk line dispenser 10. Referring to FIGS. 1 and 9 reel 80 has an axis of rotation perpendicular to the side wall and parallel to the flat area of the bottom surface 14. The disc shaped seal 132 defines a plane positioned at an angle to the plane defined by the flat area of the bottom surface 14.

Figure 7:
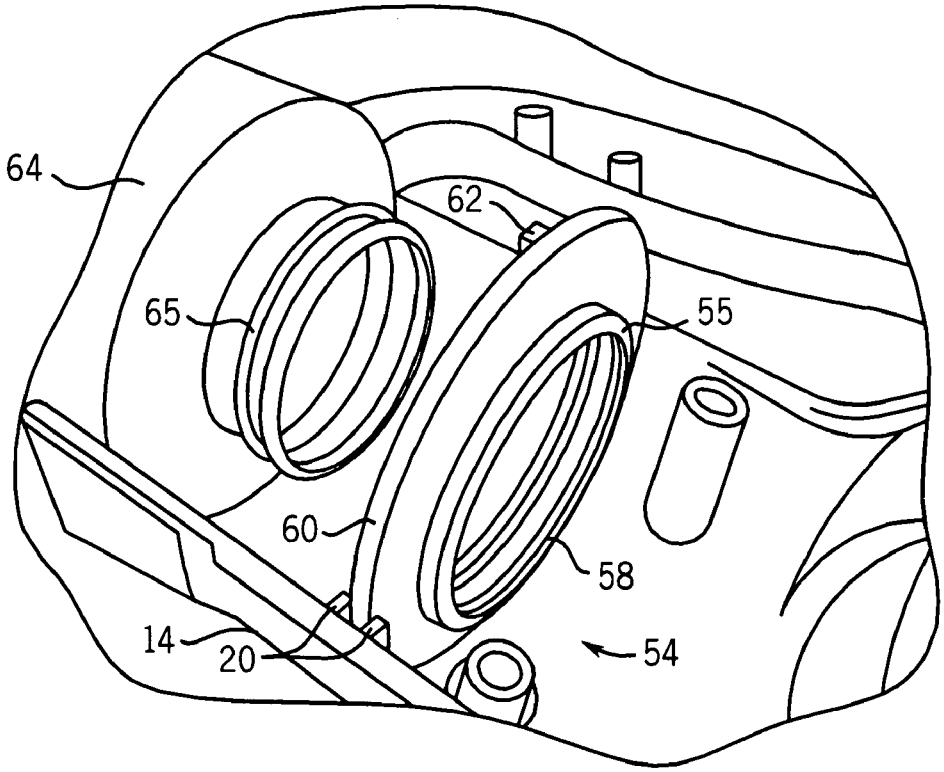
FIG. 7 is a perspective view of the rear of the chalk box in FIG. 1 showing a mechanism for coupling a container to the body of the chalk box.

Chamber 16 at least partially encloses reel mechanism 66 and is configured to contain a supply of chalk to coat a string 100. Receiving structure 18 extends outward from chamber 16 and is configured to receive an insert 54 and a container 64 of chalk. As shown in FIG. 7, insert 54 is a generally annular body that includes a flange 60 extending outward from a circular side wall 56. Flange 60 is configured to interfaces with corresponding ridges 20 on receiving structure to couple insert 54 to body 12. Insert 54 also includes protrusions or nubs 62 that extend upward from flange 60 and are received in a gap, break, or slot 22 in one or both ridges 20 to further couple insert 54 to body 12 and orientate insert 54 relative to chalk box 10. Side wall 56 of insert 54 includes threads 58 extending inward from the inner surface of side wall 56. Threads 58 are configured to engage corresponding threads 65 on a container 64 to couple container 64 to body 12 and allow chalk to move from the interior of container 64 into chamber 16. According to an exemplary embodiment, container 64 is of a type well-known in the art. Because chalk box 10 is configured to receive a container 64 of chalk, a user will have to stop less frequently to refill chalk box 10. According to other exemplary embodiments, insert 54 may be replaced with another insert to receive a container of a different size.

Handle 24—extends upward from chamber 16 to provide a user with a means of gripping chalk box 10. According to an exemplary embodiment, handle 24 forms an arch that is connected to chamber 16 on one end and receiving structure 18 on another end. According to other exemplary embodiments, handle 24 may only be attached on one end and be a cantilevered structure. Handle 24 may include a non-slip coating or other surface treatment to improve a user's ability to grip chalk box 10.

Reel mechanism 66 is provided to allow a user to retract string into chamber 16 so that string 100 can be coated with chalk. Reel mechanism 66 uses a planetary gear arrangement to magnify a rotational input by the user so that string 100 is retracted more quickly into chamber 16. Reel mechanism 66 comprises a reel 68, planetary gears 84, a cover plate 80, a ring or retainer 86, a crank of arm 90, a handle or knob 92, first seal 94 and second seal 96.

Reel 68, shown best in FIG. 11, is configured rotate within chamber 16 and hold a length of string 100 that may be wound or unwound from reel 68. Reel includes a main body that receives string 100, two flanges 72 that extend outward from body, and a first or sun gear 76 that extends outward from body generally perpendicular to flanges 72. Sun gear 76 includes a tooth portion 78 that extends through a hole or opening in one of body halves 14 and engages second or planetary gears 84 and a wall portion 79 that is generally retained in body.

Planetary gears 84, shown in FIG. 10 engage sun gear 76 and a third or hub gear 46 that is integrally formed with body 12. Planetary gears 84 rotate on posts or studs 82 on a cover plate 80. Cover plate 80 is retained by a ring or retainer 86. Retainer 86 is coupled to body 12 with fasteners 88 and traps cover plate 80 against body 12 while allowing cover plate 80 to rotate. Cover plate 80 is rotated by a user with a crank or arm 90 that is coupled to cover plate 80. A handle or knob 92 is provided on an end of arm 90 to allow a user to comfortably grasp arm 90. When a user turns cover plate 80 with arm 90, planetary gears 84 revolve between hub gear 46 and sun gear 76 and causes sun gear 76 to rotate. Depending on the direction a user turns cover plate 80, this will cause string to either wind onto or unwind from reel 68. In practice, string 100 is generally unwound from reel by simply pulling it by the end of string or with a device, shown as ring 102, coupled to the end of string 100. If a user desires to "lock" chalk box 10 so that string 100 may not be unwound by pulling it, arm 90 may be stowed such that knob 92 is received by a hollow or socket 52 in body 12, preventing cover plate 80 and reel 68 from turning.

Chalk is an abrasive substance and can cause excessive wear and binding if it is allowed to enter the area where gears 46, 76, and 84 are engaging each other. To help retain chalk in chamber 16, away from gears 46, 76, and 84, two seals 94, 96 are provided between reel 68 and body 12. As shown in FIG. 9, seals 94, 96 a generally annular pads approximately 3 mm thick composed of wool fiber. According to other exemplary embodiments, seals 94, 96 may have a thickness greater than or less than 3 mm. According to still other exemplary embodiments, seals 94, 96 may be comprise another fiber, or may be another material that suitably retains chalk in chamber 16 while allowing reel 68 to rotate relative to body 12. First seal 94 is retained between circular ridge 74 that extend upward from a flange 72 and a circular ridge 50 that extends inward from the inner wall of one of body halves 14 (shown in FIGS. 8 and 12). Second seal 96 is retained between ridge 74 and wall portion 79 of sun gear 76. When body halves 14 are coupled together with fasteners 136, seals 94, 96 are compressed between reel 68 and body 12.

According to an exemplary embodiment, string 100 is a braided nylon line with a twisted three-strand core. String 100 is configured to have a relatively low elasticity. Because it has a generally round cross-section and low elasticity, string 100 produces a relatively clean line. According to other exemplary embodiment, chalk box 10 may use any string or chord commonly known in the art.

Figure 12:
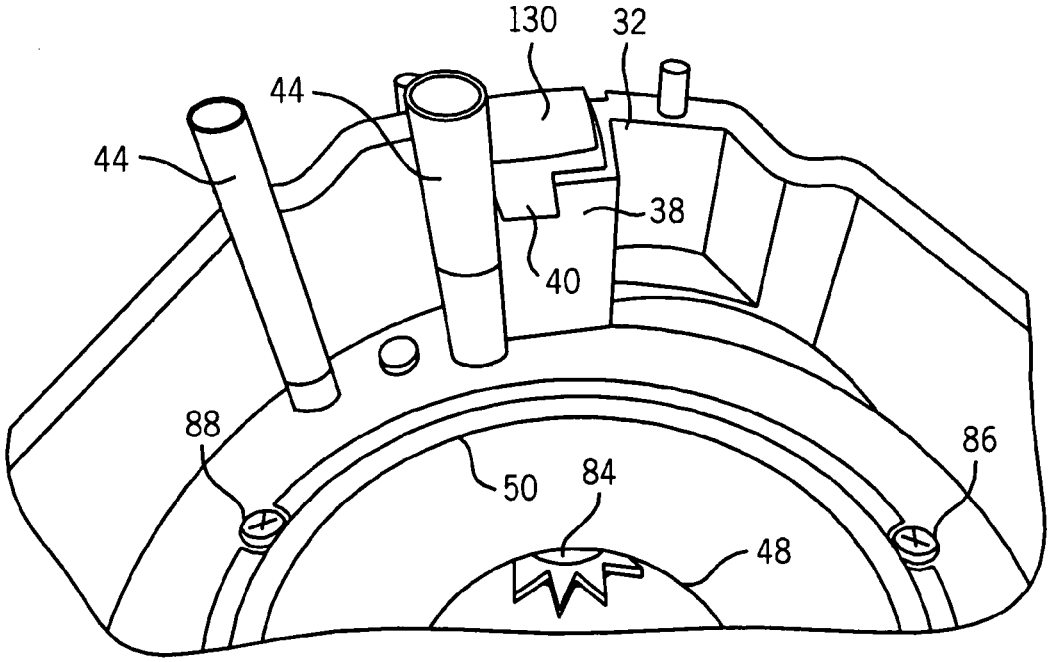
FIGS. 12 and 13 are perspective views of the nose portion of the chalk box in FIG. 1.
Figure 13:
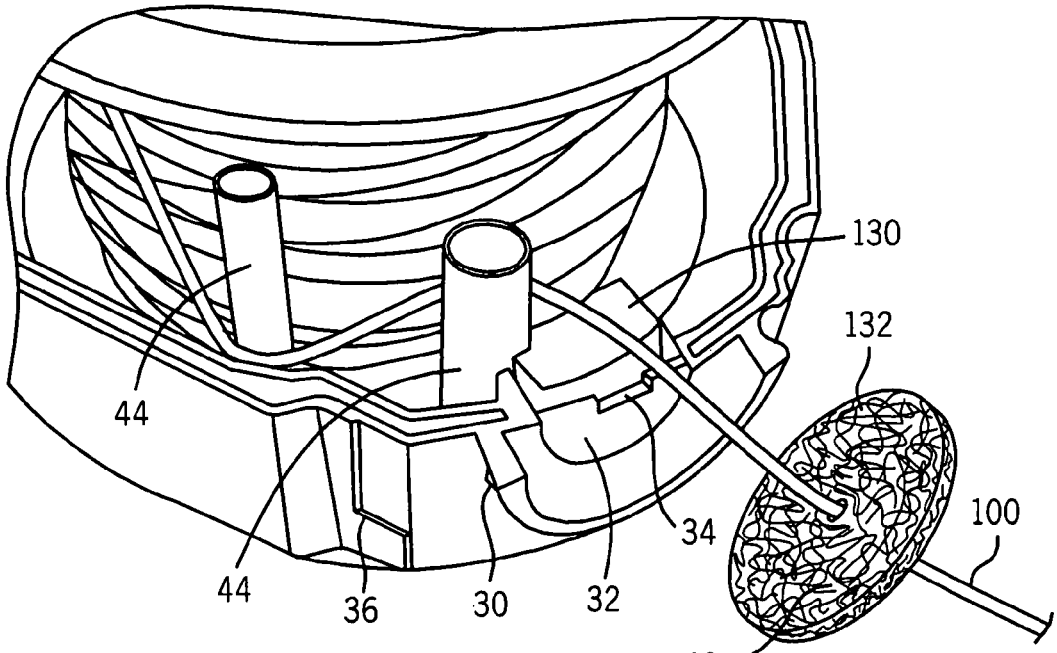

As shown in FIGS. 12 and 13, nose or outlet portion 26 is generally opposite of receiving structure 18 and is configured to provide an outlet for string 100. String 100 extends from reel mechanism 66 and over a series of posts or bosses that extend inward from the inner surface of main body. The posts have sleeves or bearings 44 that reduce wear on posts by string 100. According to an exemplary embodiment sleeves 44 are brass. According to other exemplary embodiments, sleeves 44 may be another material with suitable wear properties. Nose portion 26 includes interior walls 38 that are configured to at least partially surround and retain inner seals or filters 130 that are intended to retain chalk in chamber 16. According to an exemplary embodiment, seals 130 are generally prismatic pads approximately 10 mm thick composed of wool fiber. According to other exemplary embodiments, inner seals 130 may have a thickness greater than or less than 10 mm. According to still other exemplary embodiments, seals 130 may be comprise another fiber, or may be another material that suitably retains chalk in chamber 16 while allowing string 100 to exit chamber 16. Inner seals 130 have a thickness such that both inner seals 130 together have a thickness that is greater than the distance between walls 38 when pads are uncompressed. When inner seals 130 are inserted between walls 38 they are compressed. String 100 extends between inner seals 130 which are compressed between walls 38 to exert a force on string 100. Clips or guards 40 may be coupled to inner walls 38 to provide a wear surface and reduce wear on inner walls 38 by string 100. According to an exemplary embodiment, clips 40 are brass. According to other exemplary embodiments, clips 40 may be any material with suitable wear properties.

As string 100 is pulled from chamber 16 or retracted into chamber 16, reel mechanism 66 rotates. The rotational momentum of reel mechanism 66 may cause reel mechanism 66 to rotate such that the rate that string enters chamber 16 is different than the rate at which string 100 is taken up by reel 68. In typical chalk boxes, this may cause string 100 to loosen from reel 68, doubling back on itself or otherwise binding in reel mechanism 66. Routing string over sleeves 44 and exerting a pressure on string with inner seals 130 causes a tension on string 100 and reduces the chance for string 100 to bind in reel mechanism 66.

Nose portion 26 further includes an end wall 32 with an aperture, hole or outlet 34. String 100 extends outward through aperture 34. A generally circular extension or wall 28 extends outward from end wall 32 around aperture 34. An outer seal 132 is provided between nose portion 26 and maintenance cap 110 that is configured to exclude moisture or outside debris from entering chamber 16 and fouling chalk. Outer seal includes a slit or cut 134 that allows string to pass through outer seal 132. According to an exemplary embodiment, outer seal 132 is a generally cylindrical wool pad approximately 5 mm thick. According to other exemplary embodiments, outer seal 132 may have a thickness greater than or less then 5 mm. According to still other exemplary embodiments, seal 132 may be comprise another fiber, or may be another material that suitably excludes debris from chamber 16 while allowing string 100 to exit chamber 16.

Figure 14:
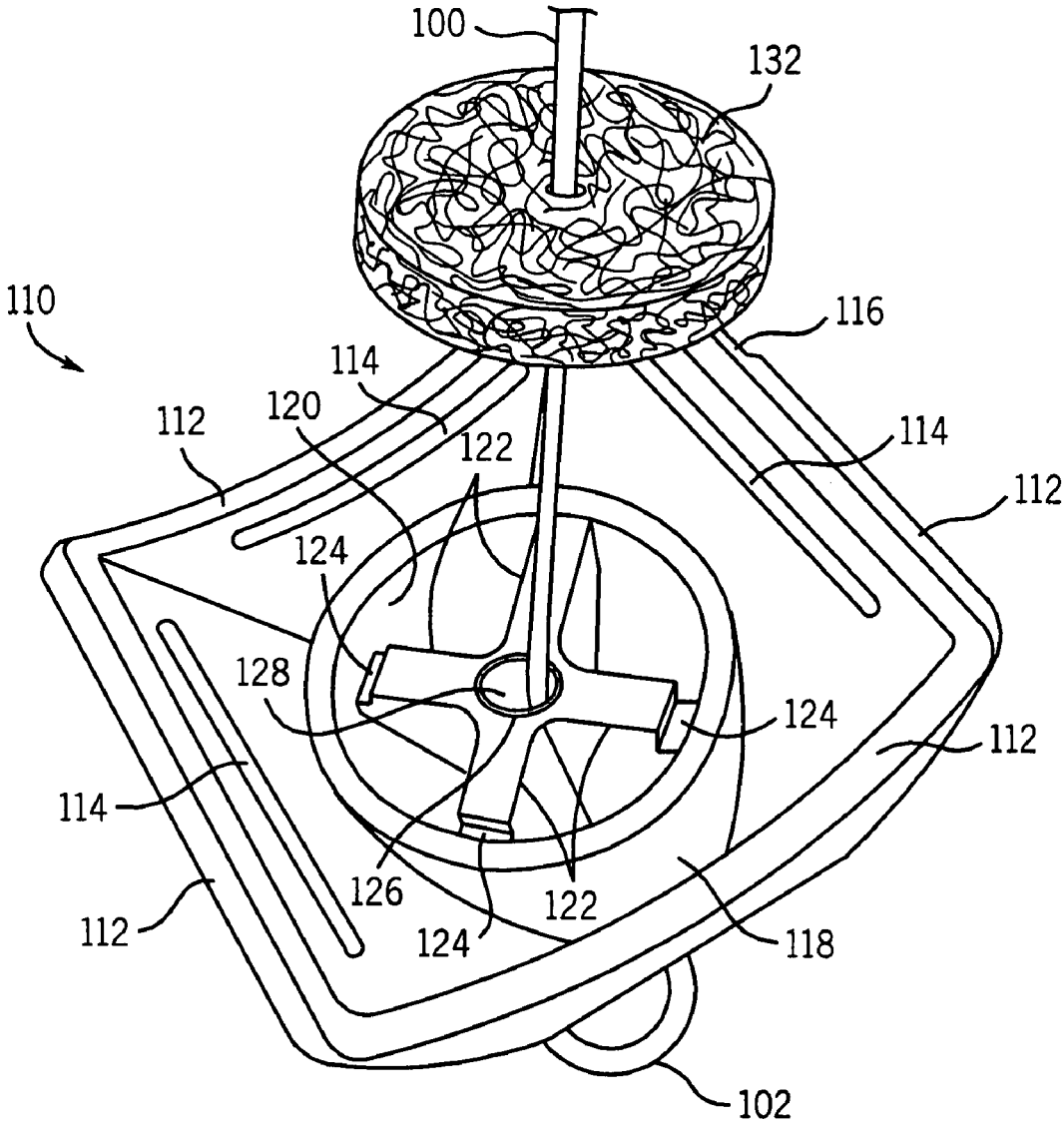
FIG. 14 is a perspective view of the cap and outer seal for the chalk box in FIG. 1.

Maintenance cap or nose cap 110 is coupled to body 12 around outlet 34 and helps prevent moisture and debris from entering the interior of body 12. Maintenance cap 110 is configured to be coupled to body 12 with a snap fit so that a user may quickly easily remove cap 110 without removing any fasteners. As shown in FIG. 14 and according the an exemplary embodiment, maintenance cap 110 is generally wedge-shaped and includes four outer walls 112, a circular inner wall 118, a plurality of radial support walls 122, and a passage, hole, or hole 126 that allows string 100 to pass through cap 110. Outer walls 112 provide a substantially continuous contour with body 12 and include channels, depressions, or recessed areas 114 on the inner surfaces. Channels 114 are configured to interface with corresponding protrusions or ridges 36 that extend outward from body 12 to couple cap 110 to body 12. One or more of outer walls 112 may also include a slot or gap 116 that is configured to allow a user to fit a tool or other object (e.g., screwdriver, knife, coin, etc.) into slot and facilitate the removal of cap 110 from body 12.

Inner wall 118 extends away from inner surfaces of outer walls 112 and surrounds support walls 122. Inner wall 118 includes a plurality of cavities, gaps or openings 120 that extends inward from the inner surface of inner wall 118. Cavities 120 are configured to engage inwardly extending protrusions 30 on wall 28 to further couple cap 110 to body 12. According to an exemplary embodiment, four protrusions 30 and cavities 120 are provided around wall 28 and inner wall 118 respectively. According to other exemplary embodiments, cavities 120 and protrusions 30 may be greater or fewer in number, differently distributed around wall 28 and inner wall 118 or be provided as a continuous ridge and slot. Support walls 122 extend outward from a central bore 126 and provide additional rigidity to cap 110. When cap 110 is coupled to body 12, outer seal 132 is trapped between cap 110 and body 12 and compressed by support walls 122 and end wall 32. Bore, hole, or passage 126 extends through cap 110 and provides a passage for string 100 to pass through cap 110. According to an exemplary embodiment, a brass sleeve or grommet 128 is provided in bore 126 to reduce wear on cap 110 by string 100. According to other exemplary embodiments, sleeve 128 may be another material with suitable wear properties.

To help orientate cap 110 on body 12, cap 110 and body 12 may have alignment features, shown as cut-outs 124 and notch 31 (shown in FIG. 10). According to an exemplary embodiment, cut-outs 124 are provided on three of the four support walls 122 proximate to inner wall 118 and are configured to receive wall 28 on nose portion 26. The support wall 122 without a cut-out is received by a corresponding notch 31 provided on wall 28.

Outer seal 132 provides a barrier substantially reducing the ability of moisture or debris from entering chamber 16. Because debris may cling to string 100, when string 100 is retracted by reel mechanism 66, debris may collect between outer seal 132 and support walls 122 and within passage 126. A user can easily remove cap 110 from body 12 and remove the debris from cap 110 to allow easier movement of string 100.

It is important to note that the construction and arrangement of the seal system as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of this disclosure. The order or sequence of any process or method steps may be varied or re-sequenced according to alternative embodiments. Other substitutions, modifications, changes and omissions may be made in the design, operating conditions and arrangement of the various exemplary embodiments.

What is claimed is:

1. A chalk line dispenser including chalk and chalk line, the dispenser comprising:

a housing defining a chamber;

a gear system disposed in the chamber;

a reel assembly disposed in the housing and coupled to the gear box, the reel assembly including flange and a gear;

a first seal having a first diameter disposed on the flange; and a second seal having a diameter smaller than the first diameter disposed on the flange intermediate the gear and the first seal, wherein the first and second seal when compressed against the flange prevent chalk from entering the gear system.

2. The chalk line dispenser of claim 1, wherein the first and second seal are separated by a raised ridge coupled to the flange.

3. The chalk line dispenser of claim 2, wherein the ridge is integral with the flange.

4. The chalk line dispenser of claim 1, wherein the first and second seal are annular.

5. The chalk line dispenser of claim 1, wherein the gear is integral with the flange.

6. The chalk line dispenser of claim 1, wherein the first and second seal are composed of wool fiber.

7. The chalk line dispenser of claim 1, including a cap coupled to the housing, with the cap defining an aperture for chalk line movement.

8. The chalk line dispenser of claim 7, wherein the cap is selectively removable and configured to couple to the housing with a snap fit.

9. The chalk line dispenser of claim 1, including a first flat area defined by the housing, wherein the flat area facilitates housing stability during chalk line operation.

10. The chalk line dispenser of claim 9, including a second flat area aligned with the other flat area defining a plane, with both flat areas configured to stabilize the housing during chalk line operation.

11. The chalk line dispenser of claim 10, wherein the second flat area is defined by the cap.

12. A chalk line dispenser comprising:

a housing including a nose portion defining an aperture;

a chalk line reel contained in the housing, with chalk line disposed on the reel and extending through the aperture;

a cap selectively removable from the nose portion, the cap having an opening through which the chalk line exits the cap distal the aperture, the cap including an outer wall and an inner wall defining a region therebetween configured to collect debris as the chalk line is wound onto the reel.

13. The chalk line dispenser of claim 12, including an outer seal positioned between the housing and the cap and aligned with the aperture, wherein the outer seal is configured to exclude material from entering the chamber; and an inner seal aligned with the aperture, wherein the inner seal is configured to retain chalk in the chamber and exert a force on the chalk line, the inner seal being adjacent to a first side of a wall separating the housing from the nose portion and the outer seal being adjacent a second side of the wall separating the housing from the nose portion, the inner seal, and region between the outer wall and inner being located between the opening and the outer seal.

14. The chalk line dispenser of claim 12, wherein the cap includes a plurality of radial support walls and defines a passage including a grommet for chalk line movement with the passage aligned with the aperture, the cap further defines a channel configured to interface with a corresponding protrusion on the nose portion of the housing, wherein the cap is coupled to the housing.

15. The chalk line dispenser of claim 12, wherein the cap includes a flat area aligned with a bottom surface of the housing.

16. The chalk line dispenser of claim 12 further including a seal located within the cap, the region between the outer wall and the inner wall being at least partially located between the outer seal and the opening.

17. A chalk line dispenser comprising:

a housing including a nose portion, a bottom surface, a side wall, and a rear portion;

a flat area defined by at least a portion of the bottom surface proximate the rear portion;

a reel having an axis of rotation perpendicular to the side wall and parallel to the flat area of the bottom surface; and a disc shaped seal defining a plane being positioned at an angle to a plane defined by the flat area of the bottom surface, wherein the flat area facilitates housing stability during operation of the chalk line dispenser; and a cap selectively removable and configured to couple to the nose portion with a snap fit, wherein the cap includes a cap flat area, wherein the cap flat area aligns with the flat area to define a plane along the bottom surface of the chalk line dispenser.

18. The chalk line dispenser of claim 17, wherein the cap defines a passage aligned with an aperture defined in the nose portion of the chalk line dispenser.

19. The chalk line dispenser of claim 18, including a chalk line reel contained in the housing, with chalk line disposed on the reel and extending through the aperture and passage.

* * * * *